US010229794B2

(12) United States Patent
Hwang et al.

(10) Patent No.: US 10,229,794 B2
(45) Date of Patent: Mar. 12, 2019

(54) CIRCUIT BREAKER FOR INTERRUPTING DC CURRENT USING MAGNETIC FIELD

(71) Applicant: HYOSUNG HEAVY INDUSTRIES CORPORATION, Seoul (KR)

(72) Inventors: Hui-Dong Hwang, Changwon-si (KR); Byung-Chol Kim, Incheon (KR); Jung-Soo Park, Seongnam-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 305 days.

(21) Appl. No.: 15/107,748

(22) PCT Filed: Dec. 24, 2014

(86) PCT No.: PCT/KR2014/012859
§ 371 (c)(1),
(2) Date: Jun. 23, 2016

(87) PCT Pub. No.: WO2015/099470
PCT Pub. Date: Jul. 2, 2015

(65) Prior Publication Data

US 2016/0322179 A1 Nov. 3, 2016

(30) Foreign Application Priority Data

Dec. 26, 2013 (KR) ..... 10-2013-0164392

(51) Int. Cl.
*H01H 9/44* (2006.01)
*H01H 33/18* (2006.01)
*H01H 33/59* (2006.01)

(52) U.S. Cl.
CPC ..... *H01H 9/446* (2013.01); *H01H 33/18* (2013.01); *H01H 33/596* (2013.01)

(58) Field of Classification Search
CPC ..... H01H 33/18; H01H 33/59; H01H 33/596; H01H 9/446; H01H 9/30; H01H 9/44; H01H 9/54; H01H 47/00
See application file for complete search history.

(56) References Cited

U.S. PATENT DOCUMENTS 5,379,017 A * 1/1995 Katsuno ..... H01C 1/034 338/272
5,837,953 A * 11/1998 Ito ..... H01H 33/18 218/30
2003/0081360 A1* 5/2003 Holley ..... H02H 1/06 361/42

FOREIGN PATENT DOCUMENTS

JP 60253122 A * 12/1985
JP 09-050742 A 2/1997
(Continued)

*Primary Examiner* — Thienvu Tran
*Assistant Examiner* — Nicolas Bellido
(74) *Attorney, Agent, or Firm* — Novick, Kim & Lee, PLLC; Jae Youn Kim

(57) ABSTRACT

Provided is a circuit breaker for a DC current using a magnetic field, which generates a magnetic flux and extinguishes an arc current generated in a main switch. The circuit breaker includes a main switch installed in a DC line, a coil wound so as to generate a magnetic flux in a direction vertical to the direction of an arc current generated when the main switch is opened, a semiconductor switch for switching current application to the coil, a capacitor connected in series to the semiconductor switch, and a first diode for conducting the electric current of the DC line, supplied from one side of the main switch, to the capacitor, wherein the semiconductor switch is turned on, in case a fault occurs, so that the electric current is applied to the coil by the voltage charged in the capacitor.

9 Claims, 5 Drawing Sheets

(56) References Cited

FOREIGN PATENT DOCUMENTS

| | | | |
|---|---|---|---|
| JP | 2679997 | B2 | 11/1997 |
| JP | 2009-158224 | A | 7/2009 |
| KR | 10-2009-0026900 | A | 3/2009 |

* cited by examiner

CIRCUIT BREAKER FOR INTERRUPTING DC CURRENT USING MAGNETIC FIELD

TECHNICAL FIELD

The present invention generally relates to a Direct Current (DC) circuit breaker and, more particularly, to a DC circuit breaker using a magnetic field, which increases resistance to an arc current generated in a main switch by producing a magnetic flux in a direction perpendicular to that of the arc current and continuously increases the resistance to the arc current by continuously supplying a return current from a DC line and by further increasing the magnetic flux, thus extinguishing an arc.

BACKGROUND ART

Research into a DC circuit breaker for immediately blocking a fault current when a fault current occurs in a DC line has been continuously conducted. In particular, a DC circuit breaker in a High Voltage DC (HVDC) system can block a power flow occurring in a large-scale power plant within a time of 5/1000 seconds by combining a very fast mechanism with electric power electronics.

Unlike an Alternating Current (AC) current, such a DC current flows as a constant current, and thus there is a disadvantage in that, when a load short-circuit fault occurs, a fault current does not become a zero current, and a DC circuit breaker must control the flow of the fault current using a high arc current, thus making it more difficult to block a DC fault current than to block an AC fault current.

In the conventional art, a DC circuit breaker for instantaneously reducing a fault current immediately before blocking using magnetic field switching is disclosed. This DC circuit breaker is problematic in that, in spite of various advantages of a DC current, such as low inductive disturbance, high circuit stability, and excellent transmission efficiency, it is impossible to sufficiently control an arc current, thus continuously permitting a DC fault current, and consequently leading to a large-scale fire accident.

In order to solve the above problem, conventional technology for applying an arc extinction device to a DC circuit breaker is presented. This is configured such that at least one pair of magnets is arranged with a switch interposed therebetween, and an arc current is blocked by increasing resistance to the arc current. However, a high-voltage DC circuit breaker is problematic in that an arc current depending on a high current is generated, so that the volume of magnets must be increased so as to increase resistance to the arc current and there is a limitation in increasing the size of a resistor, thus decreasing the speed at which the arc current is blocked.

DISCLOSURE

Technical Problem

Accordingly, an object of the present invention is to provide a DC circuit breaker using a magnetic field, which generates arc resistance using a magnetic field applied in a direction perpendicular to that of an electric field generated in a switch, and secures sufficient arc resistance by continuously increasing the arc resistance using a fault current, thus rapidly extinguishing an arc.

Technical Solution

A DC circuit breaker using a magnetic field according to the present invention to accomplish the above object includes a main switch installed on a DC line; a coil wound to produce a magnetic flux in a direction perpendicular to a direction of an arc current generated when the main switch is opened; a semiconductor switch configured to switch application of current to the coil; a capacitor connected in series with the semiconductor switch; and a first diode configured to enable current in the line, supplied from a first end of the main switch, to be transferred to the capacitor, wherein when the fault occurs, the semiconductor switch is turned on so that the current is applied to the coil using a voltage charged in the capacitor.

In the present invention, the DC circuit breaker may further include a charging resistor for charging a voltage in the capacitor.

In the present invention, in a steady state, the current in the DC line may be supplied to the capacitor through the first diode, thus charging the capacitor.

In the present invention, when a fault occurs in a state in which the capacitor is charged, the main switch may be opened, and the semiconductor switch may be turned on, so that the current is supplied to the coil through the semiconductor switch using a voltage charged in the capacitor, and a magnetic flux is produced in a direction perpendicular to a direction of an arc current generated in the main switch using the current supplied to the coil, thus increasing a resistance to the arc current.

In the present invention, in a state in which the semiconductor switch is turned on, current in the DC line may be returned to the coil through the first diode and the semiconductor switch, thus continuously increasing the resistance to the arc current.

In the present invention, the DC circuit breaker may repeatedly perform a procedure in which the arc current flowing through the main switch is reduced due to an increase in the resistance to the arc current, and thus a magnitude of the current returned to the coil from the DC line through the first diode is further increased, and in which the resistance to the arc current is continuously increased.

In the present invention, when an arc in the main switch is extinguished due to an increase in the resistance to the arc current, the semiconductor switch may be turned off, so that supply of the current to the coil is blocked, and the current in the DC line is supplied to the capacitor through the first diode, thus enabling the capacitor to be recharged.

In the present invention, the DC circuit breaker may further include a second diode for transferring the current in the line, supplied from a second end of the main switch, to the capacitor.

Advantageous Effects

The DC circuit breaker according to the present invention can reduce loss because a DC current flows only through a main switch in a steady state.

Further, according to the resent invention, a capacitor is used to increase initial commutation speed and is connected to a main line, thus enabling the capacitor to be charged in a steady state, with the result that a separate charging circuit for generating a magnetic field is not required.

Furthermore, according to the present invention, arc resistance is continuously increased using a fault current, and thus arc resistance may be rapidly increased and an arc may be rapidly blocked.

Furthermore, according to the present invention there is an advantage in that bidirectional blocking is possible using only a single on/off controllable semiconductor device.

BEST MODE

Preferred embodiments of the present invention will be described in detail below with reference to the accompanying drawings. Descriptions of known functions or configurations which have been deemed to make the gist of the present invention unnecessarily obscure will be omitted below.

Figure 1:
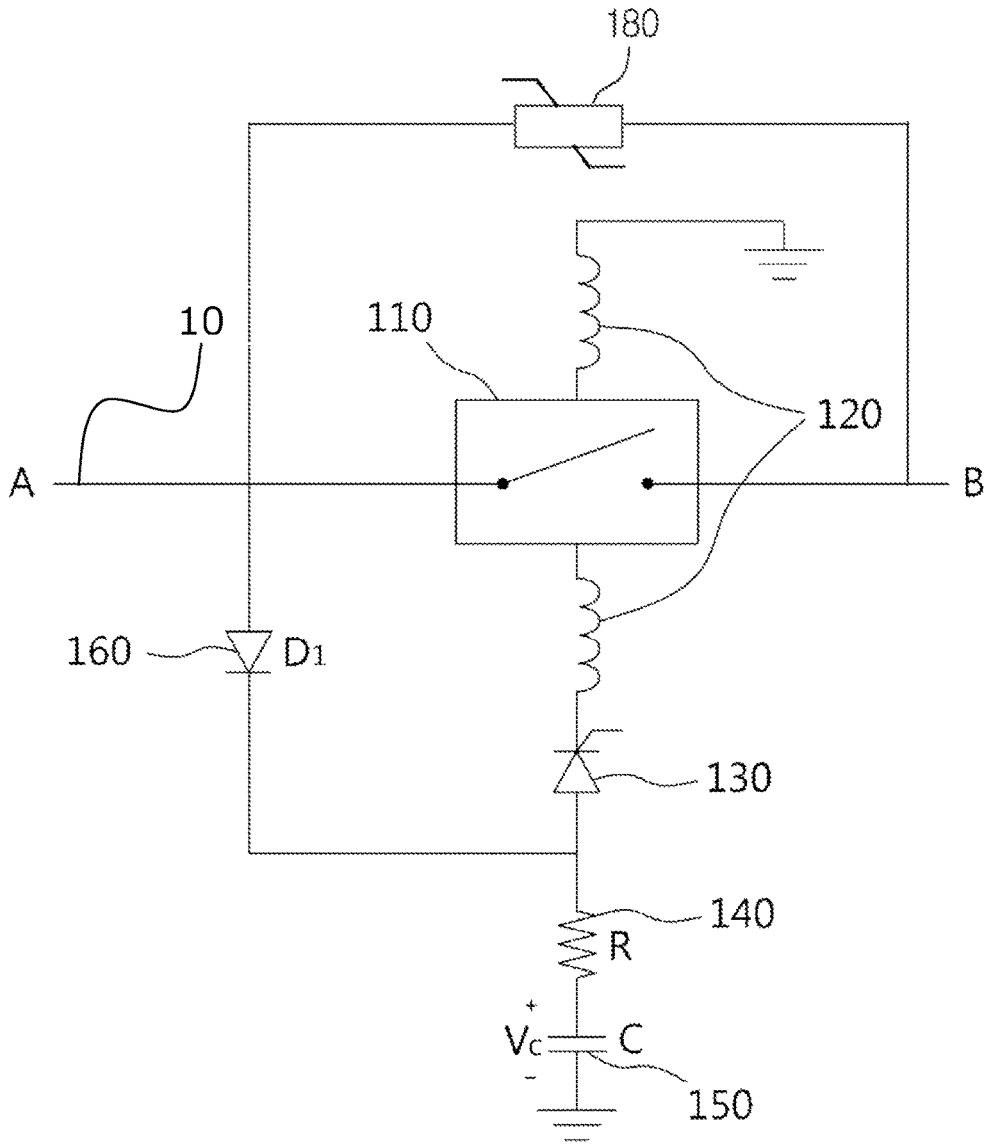
FIG. 1 is a configuration diagram showing a DC circuit breaker using a magnetic field according to an embodiment of the present invention.

FIG. 1 is a configuration diagram showing a DC circuit breaker using a magnetic field according to an embodiment of the present invention.

Referring to FIG. 1, the DC circuit breaker using a magnetic field according to the embodiment of the present invention includes a main switch 110, a coil 120, a semiconductor switch 130, a resistor 140, a capacitor 150, and a first diode 160. Preferably, the DC circuit breaker may further include a nonlinear resistor 180.

The main switch 110 is installed on a DC line 10 for connecting a first side (side A) and a second side (side B) to each other. Such a main switch 110 basically functions to block the DC line 10 in order to prevent a fault current from continuously flowing into a faulty circuit when a fault occurs on the first side (side A) or the second side (side B). In the present embodiment, such a main switch 110 may be implemented as, for example, a mechanical switch.

For this, the main switch 110 is closed in a steady state and is opened upon the occurrence of a fault. The switching operation of the main switch 110 is controlled in response to a control signal from a control unit (not shown).

The coil 120 is formed around the main switch 110 in a predetermined direction and shape and is configured to produce a magnetic flux in a certain direction by generating a magnetic field around the main switch 110. More specifically, in the present embodiment, the coil 120 is wound around the main switch 110 to enclose the main switch 110. When the main switch 110 is opened upon the occurrence of a fault, the coil 120 is wound so as to produce a magnetic flux in a direction perpendicular to the direction of an arc current generated in two end electrodes (not shown) of the main switch 110. Here, the arc current is a current flowing through an arc formed across the two end electrodes of the main switch 110, and a fault current flows through such an arc when a fault occurs. Therefore, in order for the main switch 110 to completely block the fault current, an arc current should be blocked by extinguishing the arc. Accordingly, in the present embodiment, to completely block an arc current, the coil 120 is provided so as to produce a magnetic flux in a direction perpendicular to the direction of the arc current generated in the main switch 110. In this way, when current is applied to the coil 120, the magnetic flux is produced in the direction perpendicular to that of the arc current. This magnetic flux causes the length of the arc to be increased in the perpendicular direction, thus increasing resistance to the arc current. As the current applied to the coil 120 increases, the resistance to the arc current increases. In this way, in the present embodiment, an arc is extinguished by increasing the resistance to the arc current.

The semiconductor switch 130 is connected to the coil 120 to switch the flow of current to the coil 120. That is, current is supplied to the coil 120 or the supply of the current thereto is blocked according to the turn-on/turn-off switching operation of the semiconductor switch 130. More specifically, the semiconductor switch 130 is turned on when the main switch 110 is opened, thus enabling current to be supplied to the coil 120 using a voltage charged in the capacitor 150, which will be described later, and also enabling the current in the DC line 10 to be supplied to the coil 120. When the arc formed in the main switch 110 is extinguished, the semiconductor switch is turned off and prevents the current from being supplied to the coil 120.

The resistor 140 and the capacitor 150 are connected in series with the semiconductor switch 130. Such a capacitor 150 charges a voltage depending on a predetermined condition, or supplies current to the coil 120 using the charged voltage. The resistor 140 is used to charge the voltage in the capacitor 150 using the DC current supplied from the DC line 10.

The first diode 160 functions to allow the current in the DC line 10, which is supplied from the first side (side A) of the main switch 110, to be transferred to the capacitor 150. Further, the first diode 160 functions to transfer a fault current so that the fault current flows into the coil 120 through the semiconductor switch 130 when the main switch 110 is opened.

Meanwhile, in an embodiment of the present invention, the nonlinear resistor 180 may be connected in parallel with the main switch 110. Such a nonlinear resistor 180 is configured to prevent overvoltage equal to or greater than a rated voltage from being applied across the two ends of the main switch 110 when the main switch 110 is opened, and is operated such that, when a fault voltage of a preset reference value or more is induced across the two ends of the main switch 110, the nonlinear resistor 180 is automatically turned on to consume the high voltage. The nonlinear resistor 180 may be implemented using, for example, a varistor.

The process in which the high voltage DC circuit breaker using a magnetic field according to the embodiment of the present invention, configured in this way, blocks the fault current is described below. First, in a steady state, the main switch 110 is closed, and then current in the DC line 10 is supplied from the first side (side A) to the second side (side B). Here, the first diode 160 is conducted, and current in the line 10 is supplied to the capacitor 150, thus enabling the capacitor 150 to be charged to a constant voltage (+Vc).

Thereafter, when a fault occurs on the second side (side B), the main switch 110 is opened, and the semiconductor switch 130 is turned on so as to block the current in the line 10. Here, when the main switch 110 is opened, an arc is formed, and thus an arc current flows through two end electrodes. As the semiconductor switch 130 is primarily turned on, the current is supplied to the coil 120 via the voltage (+Vc) previously charged in the capacitor 150, and a magnetic flux is produced in a direction perpendicular to the direction of the arc current generated in the main switch 110, and thus resistance to the arc current increases. The increase in resistance to the arc current decreases the magnitude of the arc current in the main switch 110.

In particular, as the semiconductor switch 130 is turned on, and the current in the line 10 is supplied to the coil 120 through the first diode 160 and the semiconductor switch 130, a higher current is supplied to the coil 120, thus further increasing the intensity of the magnetic flux, and increasing the resistance to the arc current. As the resistance to the arc current is further increased, the arc current is further decreased, and the current supplied from the line 10 is further increased, with the result that the current supplied to the coil 120 continuously increases. In this way, the procedure in which resistance to the arc current increases, and the current supplied from the line 10 to the first diode 160 increases, and in which the resistance to the arc current further increases is continuously repeated, and thus the arc current consequently becomes 0 and the arc is extinguished. In this way, the present invention further increases a magnetic flux and continuously increases the resistance to the arc current by returning the current in the line 10 to the coil 120 while producing the magnetic flux using the voltage stored in the capacitor 150, thus extinguishing the arc.

When the arc is extinguished, the semiconductor switch 130 is turned off, so that the supply of current to the coil 120 is blocked, and the current in the line 10 is supplied to the capacitor 150 and is used to recharge the capacitor 150.

Figure 2:
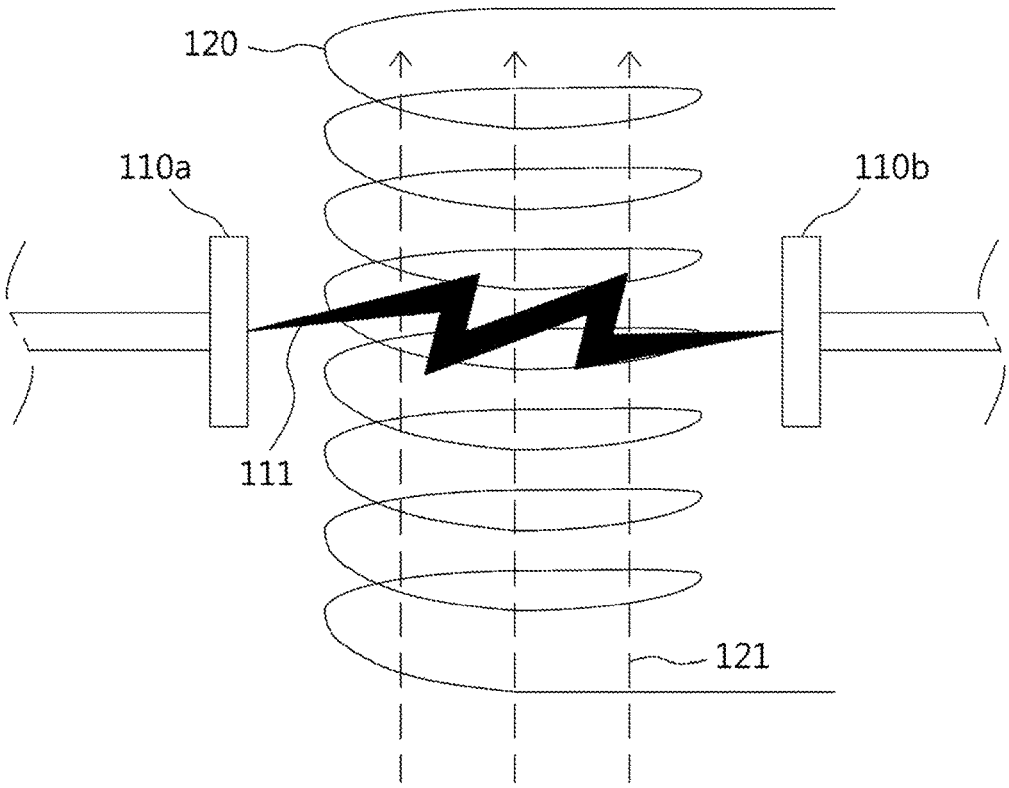
FIG. 2 is a conceptual diagram showing an increase in arc resistance depending on the influence of a magnetic field in the DC circuit breaker according to the embodiment of the present invention.

FIG. 2 is a conceptual diagram showing an increase in arc resistance depending on the influence of a magnetic field in the DC circuit breaker according to the embodiment of the present invention.

Referring to FIG. 2, in the DC circuit breaker according to the present invention, when a fault occurs, the main switch 110 is opened. The main switch 110 is opened as both end electrodes 110*a* and 110*b* of the main switch 110 are connected to each other and they are then physically separated from each other in that state. At this time, while two end electrodes 110*a* and 110*b* are separated from each other, dielectric breakdown occurs to form an arc 111, and thus an arc current continuously flows through the arc 111. Then, the coil 120 is arranged and wound so that a magnetic flux 121 is produced in a direction perpendicular to the direction of flow of the arc current. That is, when two end electrodes 110*a* and 110*b* of the main switch 110 are horizontally arranged, as in the example shown in the drawing, the coil 120 is vertically wound. Therefore, the magnetic flux 121 is produced in a vertical direction.

When the magnetic flux 121 is produced perpendicularly to the arc current in this way, Lorentz force is produced in a direction perpendicular to both an electric field and a magnetic field based on the Fleming's left hand rule, and the arc is extended perpendicularly, thus increasing the length of the arc. This shows that, as the intensity of the magnetic flux is higher, the length of the arc is further increased, and as the length of the arc becomes larger, the resistance to the arc current is further increased. The increase in resistance to the arc current increases the magnitude of the return current supplied from the line 10 to the coil 120, so that the magnetic flux 121 in the coil 120 is further increased, and thus the resistance to the arc current is continuously increased, and the arc current consequently becomes zero (0), with the result that the arc is extinguished.

Figure 3A:
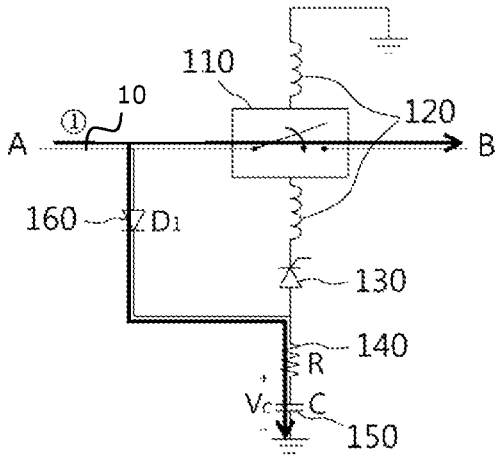
FIGS. 3(*a*), 3(*b*) and 3(*c*) are diagrams showing the operation of a DC circuit breaker using a magnetic field according to an embodiment of the present invention.
Figure 3B:
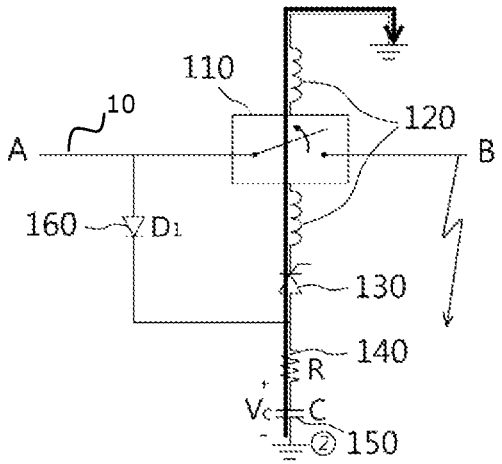
Figure 3C:
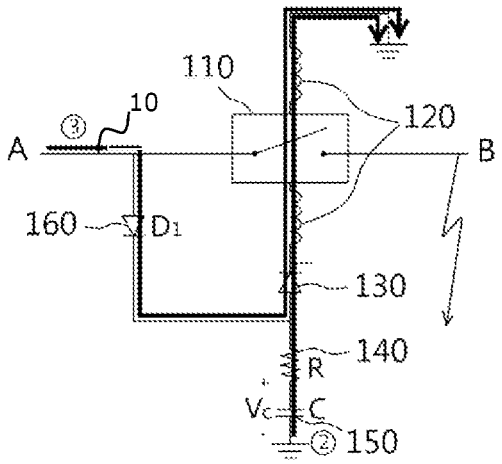

FIGS. 3(*a*), 3(*b*) and 3(*c*) are diagrams showing the operation of a DC circuit breaker using a magnetic field according to an embodiment of the present invention.

Referring to FIG. 3(*a*), in a steady state, the main switch 110 is closed, and the semiconductor switch 130 is turned off. Therefore, the steady state current of the DC line 10 is supplied from the first side (side A) to the second side (side B) through the main switch 110. Here, the steady state current of the DC line 10 flows through the first diode 160 and the resistor 140, and is supplied to the capacitor 150 while charging a predetermined voltage (+Vc) in the capacitor 150.

As shown in FIG. 3(*b*), when a fault occurs on side B, the control unit (not shown) detects the occurrence of a fault, and turns on the semiconductor switch 130 while opening the main switch 110. As described above, when the main switch 110 is opened, an arc is formed across the two end electrodes 110*a* and 110*b* of the main switch 110, and thus an arc current continuously flows from side A to side B. Here, as the semiconductor switch 130 is turned on, current instantaneously flows through the resistor 140 and the semiconductor switch 130 using the voltage (+Vc), previously charged in the capacitor 150, and is then supplied to the coil 120. In this way, a magnetic flux is produced in the coil 120 in a direction perpendicular to the direction of the flow of the arc current, so that the length of the arc is increased, and thus the resistance to the arc current is increased.

Here, as shown in FIG. 3(*c*), a return current in the DC line 10 is applied to the coil 120 through the first diode 160 and the semiconductor switch 130, the magnetic flux is further increased. This further increases the resistance to the arc current. The increase in resistance results in a decrease in the arc current and an increase in the return current in the line 10, so that these procedures are repeated to continuously increase the resistance to the arc current, and the arc current finally becomes zero (0), thus enabling the arc to be extinguished.

Figure 4:
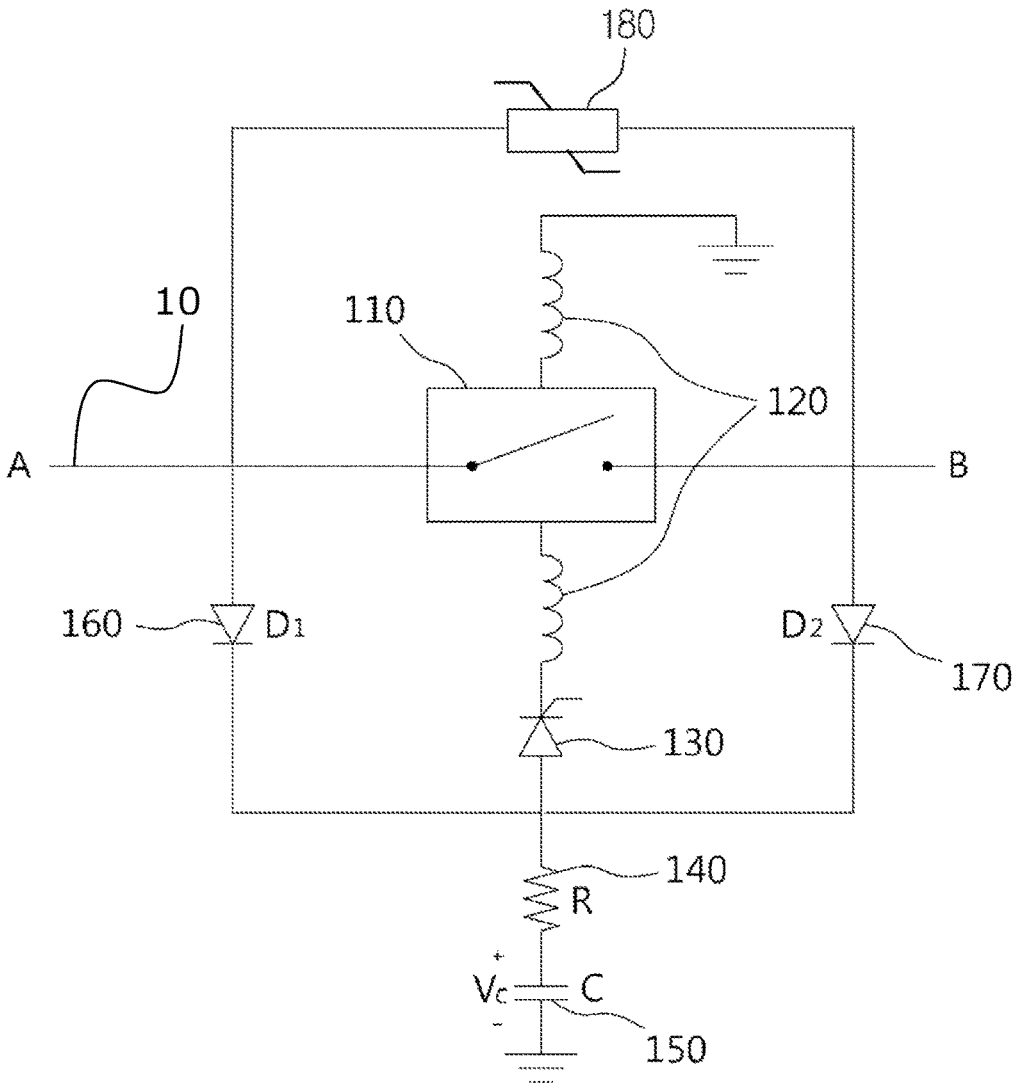
FIG. 4 is a configuration diagram showing a DC circuit breaker using a magnetic field according to another embodiment of the present invention.

FIG. 4 is a configuration diagram showing a DC circuit breaker using a magnetic field according to another embodiment of the present invention.

Referring to FIG. 4, another embodiment of the present invention is configured to further include a second diode 170 connected to a DC line 10 on a second side (side B). That is, compared to the embodiment shown in FIG. 1, the second diode 170 is connected to the line 10 on the second side (side B) to be symmetrical with a first diode 160 connected to the line 10 on the first side (side A). Such a second diode 170 performs the same function as the first diode 160. However, the second diode is applied when a DC current is supplied from the second side (side B) to the first side (side A). Hence, bidirectional blocking is possible in the present invention.

As described above, although the present invention has been described in detail with reference to preferred embodiments, it should be noted that the present invention is not limited to the description of these embodiments. It is apparent that those skilled in the art to which the present invention pertains can perform various changes or modifications of the present invention without departing from the scope of the accompanying claims and those changes or modifications belong to the technical scope of the present invention although they are not presented in detail in the embodiments. Accordingly, the technical scope of the present invention should be defined by the accompanying claims.

The invention claimed is:

1. A circuit breaker for interrupting a DC current using a magnetic field, comprising:

a main switch installed on a DC line;

a coil wound to produce a magnetic flux in a direction perpendicular to a direction of an arc current generated when the main switch is opened;

a semiconductor switch configured to switch application of a current to the coil;

a capacitor connected in series with the semiconductor switch; and a first diode configured to enable a current in the DC line, supplied from a first end of the main switch, to be transferred to the capacitor, wherein, when a short circuit fault in the DC line occurs, the semiconductor switch is turned on so that a current is applied to the coil using a voltage charged in the capacitor, wherein, when the semiconductor switch is turned on, the current is supplied to the coil through the semiconductor switch using the voltage charged in the capacitor, and the magnetic flux is produced in the direction perpendicular to the direction of the arc current, generated in the main switch, using the current supplied to the coil, to increase a resistance to the arc current, and wherein a current in the DC line is returned to the coil through the first diode and the semiconductor switch to continuously increase the resistance to the arc current.

2. The circuit breaker of claim 1, further comprising a charging resistor for charging the voltage in the capacitor.

3. The circuit breaker of claim 1, wherein, in a steady state, the current in the DC line is supplied to the capacitor through the first diode to charge the capacitor (150).

4. The circuit breaker of claim 1, wherein the circuit breaker repeatedly performs a procedure in which the arc current flowing through the main switch is reduced due to an increase in the resistance to the arc current, and thus a magnitude of the current returned to the coil DC line through the first diode is further increased, and in which the resistance to the arc current is continuously increased.

5. The circuit breaker of claim 4, wherein, when an arc in the main switch is extinguished due to an increase in the resistance to the arc current, the semiconductor switch is turned off, so that supply of the current to the coil is blocked, and the current in the DC line is supplied to the capacitor through the first diode, thus enabling the capacitor to be recharged.

6. The circuit breaker of claim 1, further comprising a second diode for transferring the current in the DC line, supplied from a second end of the main switch, to the capacitor.

7. The circuit breaker of claim 2, wherein, in a steady state, the current in the DC line is supplied to the capacitor through the first diode, thus charging the capacitor.

8. The circuit breaker of claim 1, wherein the circuit breaker repeatedly performs a procedure in which the arc current flowing through the main switch is reduced due to an increase in the resistance to the arc current, and thus a magnitude of the current returned to the coil from the DC line through the first diode is further increased, and the resistance to the arc current is continuously increased.

9. The circuit breaker of claim 2, further comprising a second diode for transferring the current in the DC line, supplied from a second end of the main switch, to the capacitor.

* * * * *